US005566135A

United States Patent [19]

MacLeod

[11] Patent Number: 5,566,135

[45] Date of Patent: Oct. 15, 1996

[54] DIGITAL TRANSDUCER

[75] Inventor: Robert B. MacLeod, Newport, R.I.

[73] Assignee: The United States of America as represented by the Secretary of the Navy, Washington, D.C.

[21] Appl. No.: 511,492

[22] Filed: Jul. 11, 1995

[51] Int. Cl.[6] ..... H04R 1/02

[52] U.S. Cl. ..... 367/149; 367/150; 356/400

[58] Field of Search ..... 367/149, 150; 356/400

[56] References Cited

U.S. PATENT DOCUMENTS

| | | | |
|---|---|---|---|
| 4,599,711 | 7/1986 | Cuomo | 367/141 |
| 5,247,490 | 9/1993 | Goepel et al. | 367/149 |
| 5,249,163 | 9/1993 | Erickson | 367/149 |

*Primary Examiner*—J. Woodrow Eldred

*Attorney, Agent, or Firm*—Michael J. McGowan; William F. Eipert; Prithvi C. Lall

[57] ABSTRACT

A device for converting mechanical vibrations into a digital signal uses a diaphragm having a reflective surface with a plurality of reflective facets disposed on a face of the diaphragm. The diaphragm is mounted such that it will be displaced a distance proportional to the external stimulus, such as acoustic energy, it receives. A light source provides a continuous optical beam which is directed onto the reflective surface and reflected by the surface onto an optical detector, which in turn, produces an electrical signal identifying the position on the detector illuminated by the reflected beam. As the diaphragm vibrates in response to the external stimulus receive, the optical beam will be reflected in different directions thereby changing the position that the beam strikes the optical detector. A microprocessor receives the electrical signals from the optical detector and produces a digital signal corresponding to the displacement of the diaphragm.

6 Claims, 3 Drawing Sheets

DIGITAL TRANSDUCER

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The present invention relates to a transducer which directly converts mechanical vibrations into a digital signal. More specifically, the present invention relates to a digital microphone wherein acoustic energy may be directly converted into a digital signal.

(2) Description of the Prior Art

There are numerous advantages of storing information in a digital format. For example, digital data storage often enhances and accelerates duplication, reproduction and distribution processes. Additionally, unlike other forms of data storage, digital storage enables comprehensive and sophisticated analysis and modification of stored data with little or no degradation of the data. These benefits have been used to restore, preserve, enhance, analyze and duplicate audio signals and recordings. However, many of the benefits of digital storage and processing are not fully realized when applied to acoustic signals due to inherent limitations in the process of converting acoustic signals to digital data.

The process of converting acoustic signals to digital data typically involves two conversions. First, the acoustic signal is converted to an analog signal using a conventional microphone or similar device. Second, an analog to digital converter (A/D converter) is employed to convert the analog signal to digital data. Both conversions are susceptible to noise and distortion. While high-speed, high-accuracy microphones and A/D converters can reduce the susceptibility to and the amount of noise and distortion, they do not eliminate it. Additionally, such high-speed, high-accuracy equipment is expensive, making its use prohibitive for many applications.

Eliminating a conversion step removes noise and distortion associated with that step as well as eliminating the possibility of compounding any noise or distortion introduced in previous conversion steps. Digital microphones, such as those described in U.S. Pat. No. 3,286,032 and U.S. Pat. No. 4,422,182, produce digital data directly from an acoustic signal, thus reducing the number of conversions required from two to one. However, such digital microphones generally suffer from one or more disadvantages which limit their use for many applications.

One such disadvantage is the limited sensitivity to and resolution of acoustic signals typically available from digital microphones. Digital microphones generally are not capable of providing the resolution required for high fidelity audio recordings such as that required for digital audio tape and compact audio disk recordings. Furthermore, prior art microphones such as the one described in U.S. Pat. No. 4,422,182, typically require large complex patterns detailing every possible bit pattern superimposed on a reflecting surface or an optical array. The use of such conventional digital microphones is also limited because they generally require complicated circuitry which increases the cost and size of the microphones. The size, cost, and complexity of digital microphones, as well as the low resolution often associated with them, make the use of conventional digital microphones prohibitive for many applications.

SUMMARY OF THE INVENTION

Accordingly, it is a general purpose and object of the present invention to provide a digital transducer to directly convert acoustic energy into a digital signal.

A further object of the present invention is the provision of a digital transducer having greater sensitivity and digital resolution than previously available.

Yet a further object of the present invention is to provide a digital transducer to directly convert acoustic energy into a digital signal without requiring relatively complex, sizable and/or expensive equipment.

These and other objects made apparent hereinafter are accomplished with the present invention by providing a diaphragm having a reflective surface comprising a plurality of reflective facets disposed on a face of the diaphragm. The diaphragm is positioned to receive acoustic energy such that it will be displaced a distance proportional to the acoustic energy it receives. A light source provides a continuous optical beam which is directed onto the reflective surface. The surface reflects the beam onto an optical detector which produces an electrical signal identifying the position on the detector that the reflected beam illuminates. In response to acoustic energy received by the diaphragm, the optical beam is reflected in different directions thus changing the position that it strikes on the optical detector. A microprocessor receives the electrical signals from the optical detector and produces a digital signal corresponding to the displacement of the diaphragm.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein like reference numerals and symbols designate identical or corresponding parts throughout the several views and wherein.

DESCRIPTION OF THE PREFERRED EMBODIMENT

Figure 1:
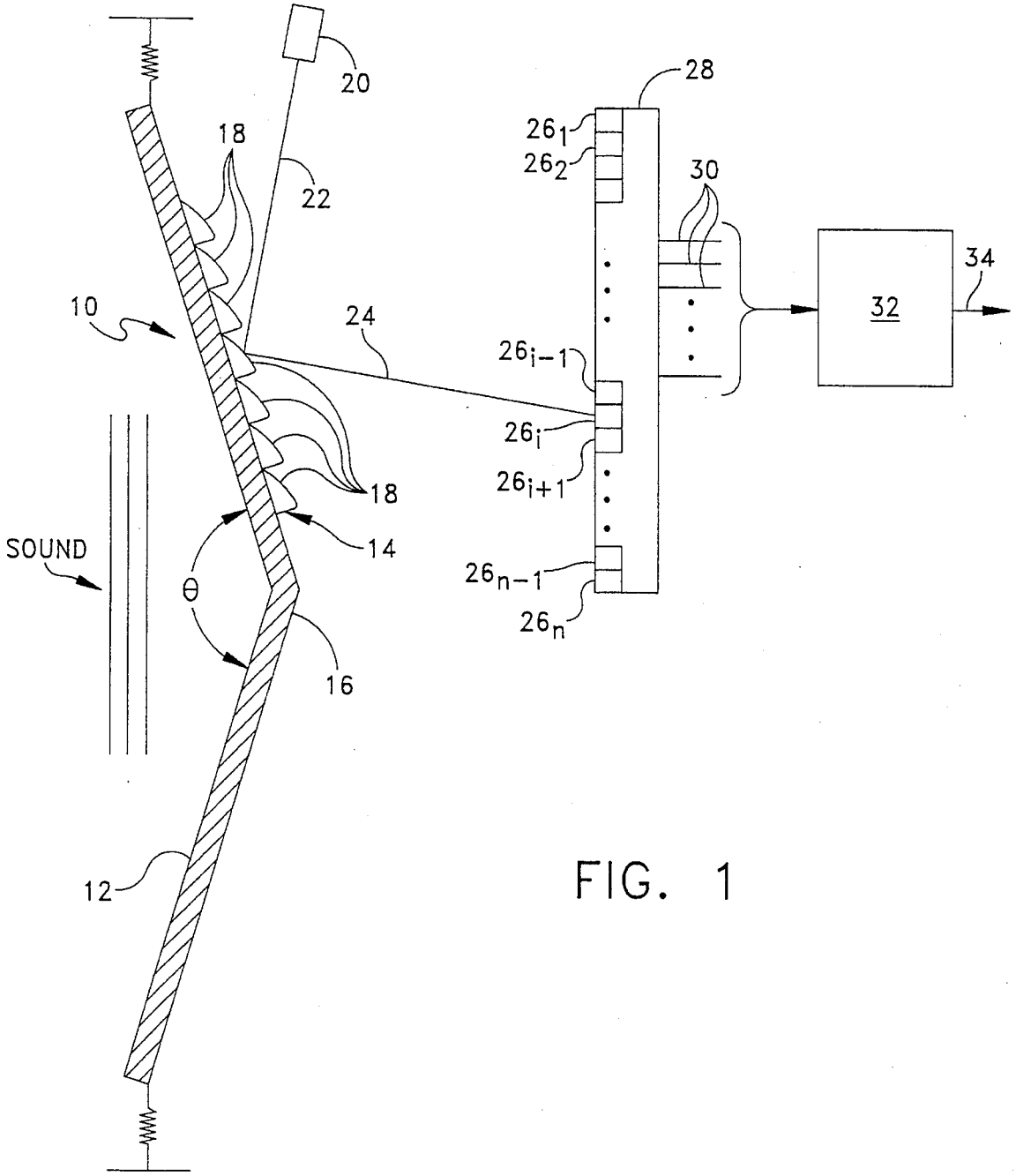
FIG. 1 is a diagram illustrating an embodiment of a digital microphone in accordance with the present invention.

Referring now to FIG. 1, there is shown a diagram of a digital microphone in accordance with the present invention. In FIG. 1, a diaphragm 10 is positioned to receive acoustic energy incident upon face 12 of diaphragm 10. Diaphragm 10 can be any conventional microphone diaphragm, ribbon or cone, which will vibrate with a motion proportional to the amplitude of the acoustic energy received at face 12. In the cone diaphragm 10, the angle, θ, at the vertex of the cone can be any angle $0°<\theta\leqq 180°$. Diaphragm 10 can be mounted in the microphone using any of several conventional and well known methods. Diaphragm 10 further comprises a faceted reflective surface 14 fixed to face 16. Face 16 is the side of diaphragm 10 that is opposite face 12. Reflective surface 14, which can be mounted on or constructed integrally with diaphragm 10, comprises a plurality of smooth, reflective facets 18.

A source 20, such as a light emitting diode, a semiconductor laser, or the like, produces an optical beam 22 that is directed onto reflective surface 14. Beam strikes one of the facets 18 of surface 14 and is reflected (as beam 24) onto an optical detector $\mathbf{26}_i$ within detector array 28. The position on, as well as the facet of, reflective surface 14 that beam 22 strikes varies as diaphragm 10, and thus surface 14, moves. Changing the position on surface 14 that beam 22 strikes changes the direction that beam 24 is reflected; thereby changing the position at which beam 24 strikes detector array 28. A complete description of the variation in the position at which beam 22 strikes surface 14 is discussed below in reference to FIGS. 2 and 3. Source 20 can emit beam 22 directly onto surface 14 (as shown in FIG. 1) or source 20 can be located some distance away with optical beam 22 directed to surface 14 by conventional means, such as fiber optic cable, mirrors, or the like.

Optical detector array 28 has an optically sensitive surface comprising a linear array of opto-electric transducers 26. The array consists of n transducer elements ($\mathbf{26}_1$, $\mathbf{26}_2$, . . . , $\mathbf{26}_n$) wherein individual transducers are generally identified as $\mathbf{26}_i$. Each opto-electric transducer $\mathbf{26}_i$, which can be a charge coupled device, phototransister, photodiode or the like, produces an electrical response proportional to the intensity of light received at the transducer. The transducer elements can be read serially providing at output 30 a single string of output values, read in parallel providing a plurality of output 30 connections with each individual output 30 containing a single output value from a unique element, or read in a serial/parallel combination providing a plurality of output 30 connections with each individual output 30 containing a string of output values from a set of transducer elements. Output 30 of detector array 28 is directed to microprocessor 32 which analyzes the output values transferred from detector array 28 to determine which transducers $\mathbf{26}_i$ are illuminated. Microprocessor 32 provides a digital output value which corresponds to the transducer elements illuminated and thus the position of diaphragm 12.

Figure 2:
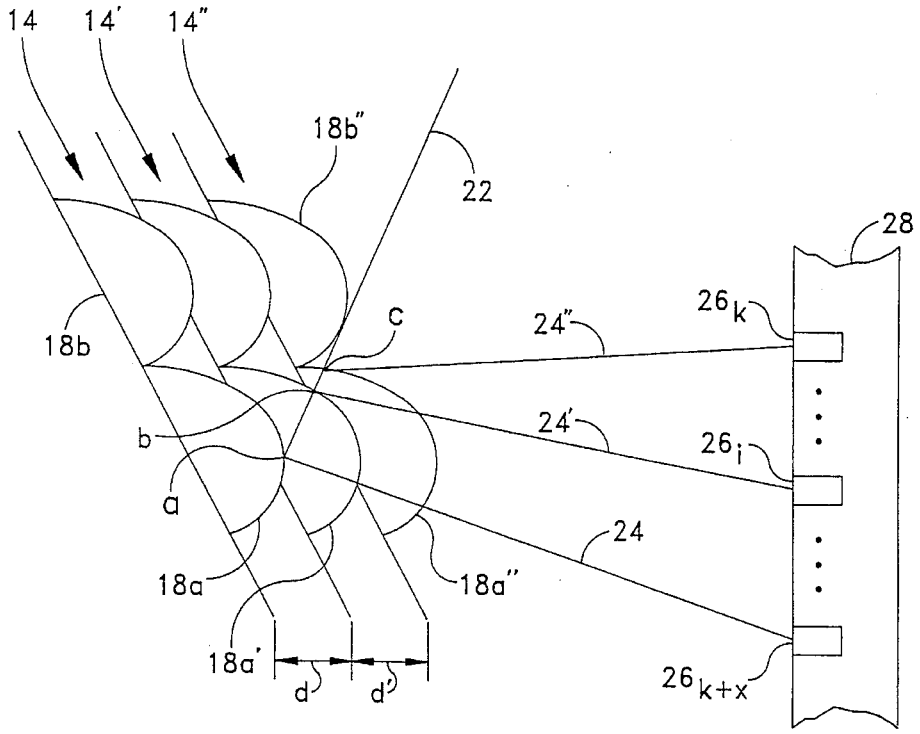
FIG. 2 is a diagram illustrating the directional variation in the reflection of a light beam in response to small changes in the amplitude of acoustic energy received by the microphone.

Referring now to FIG. 2, there is shown a diagram illustrating the variation in the positions on facet 18*a* that beam 22 strikes and the resulting changes in the direction that beam 24 is reflected as diaphragm 10 moves in response to small changes in the amplitude of the acoustic energy received. In FIG. 2, surface 14 illustrates the position of the reflective surface at time $t_0$, surface 14' represents the position of the same portion of the reflective surface at a later time $t_1$, and surface 14" shows the position of the surface at time $t_2$. Facets 18*a*, 18*a*' and 18*a*" illustrate the position of the same facet at times $t_0$, $t_1$, and $t_2$, respectively.

At time $t_0$, beam 22 strikes facet 18*a* at point a and is reflected as beam 24 which is incident upon transducer $\mathbf{26}_{k+x}$ of detector array 28. At times $t_1$ and $t_2$ the reflective surface is shown displaced a small distance (d and d', respectively) from its previous position. Such a displacement of the reflective surface can result from an increase in the amplitude of the acoustic energy received. As the reflective surface is displaced, the point at which beam 22 strikes facet 18*a* moves along the surface of the facet from point a at time $t_0$ to points b and c at times $t_1$ and $t_2$, respectively. Similarly, the position at which the reflected beam (represented by beams 24, 24', and 24") strikes detector array 28 moves from transducer $\mathbf{26}_{k+x}$ through transducer $\mathbf{26}_i$ to transducer $\mathbf{26}_k$ as beam 22 moves across the surface of facet 18*a* from point a to point c.

It should be apparent that, if the reflective surface is displaced further right of the position represented by surface 14" in FIG. 2, beam 22 would, at some point, strike facet 18*b* rather than facet 18*a*. Similarly, if surface 14 is displaced further to the left than its current position shown in FIG. 2, at some point, beam 22 would no longer strike facet 18*a*. If point a is taken to be the first point on facet 18*a* that beam 22 strikes as surface 14 moves to the right in FIG. 2 and point c is taken to be the last point on facet 18*a* that beam 22 strikes, then facet 18*a* will have a scan range of x+1 transducers (transducer $\mathbf{26}_{k+x}$ through 26*k*) as beam 22 moves across the surface of the facet. Thus, knowing the facet displacement (d+d") and the resulting scan range, one can determine the relative displacement of a facet by identifying which transducer $\mathbf{26}_i$ within the scan range is illuminated. Preferably, facets 18 of reflective surface 14 are convex (as shown in the FIG. 2) to increase the scan range and thus the number of transducer elements $\mathbf{26}_i$ scanned by reflected beam 24.

Figure 3:
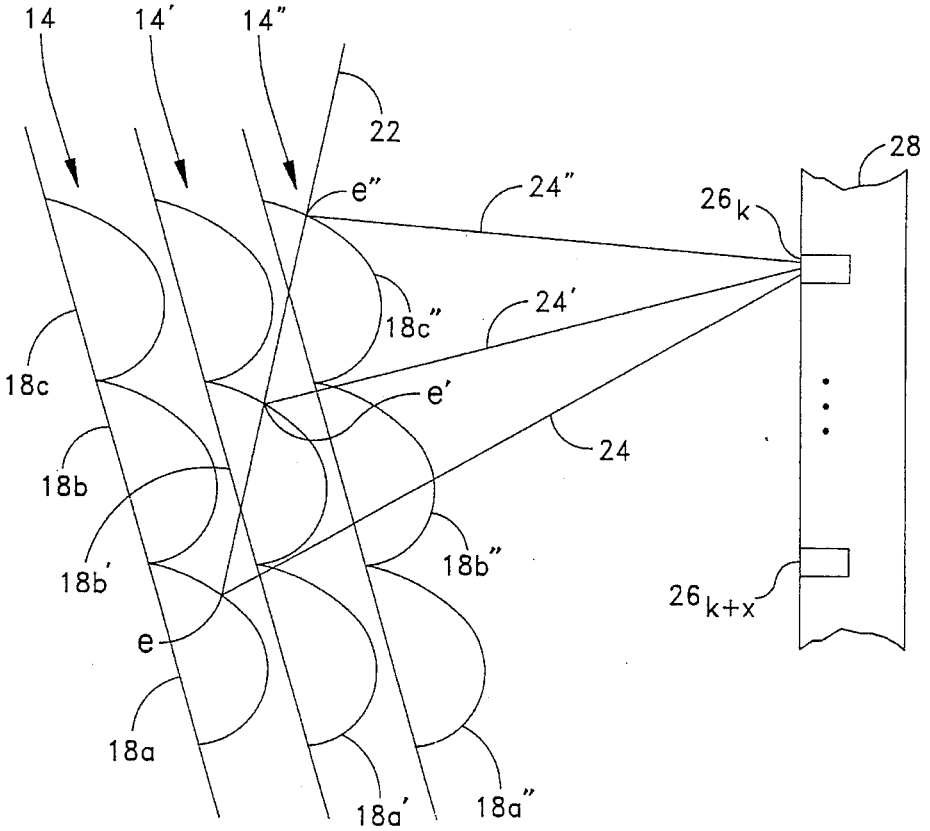
FIG. 3 is a diagram illustrating the variation in the reflection of a light beam in response to large changes in the amplitude of acoustic energy received by the microphone.

Referring now to FIG. 3, there is shown a diagram illustrating the variation in the positions at which beam 22 strikes surface 14 as diaphragm 10 moves in response to large changes in the amplitude of the acoustic energy received. In FIG. 3, surface 14 illustrates the position of the reflective surface at time $t_0$, surface 14' represents the position of the same portion of the reflective surface at a later time $t_1$, and surface 14" shows the position of the surface at yet a later time $t_2$.

At time $t_0$, beam 22 strikes facet 18*a* at point e and is reflected as beam 24 onto transducer $\mathbf{26}_k$ of detector array 28. At time $t_1$ beam 22 strikes facet 18*b*' at point e' and is reflected as beam 24' onto transducer $\mathbf{26}_k$. If points e and e' are the last points on facets 18*a* and 18*b*' that beam 22 strikes as reflective surface 14 is displaced to the right in FIG. 3, then, as discussed above in reference to FIG. 2, reflected beam 24 would scan transducers $\mathbf{26}_{k+x}$ through $\mathbf{26}_k$ in the period of time between $t_0$ and $t_1$. That is, at a time immediately after $t_0$, beam 22 will strike facet 18*b* and reflected beam 24 will strike transducer $\mathbf{26}_{k+x}$. As time increases, beam 22 will move along the surface of facet 18*b* and reflected beam 24 will move through the scan range from transducer $\mathbf{26}_{k+x}$ toward transducer $\mathbf{26}_k$ until time $t_1$ when beam 22 reaches point e' and is reflected onto transducer $\mathbf{26}_k$. Similarly, in the period of time between $t_1$ and $t_2$, beam will move across the surface of facet 18*c* and reflected beam will scan from transducer $\mathbf{26}_{k+x}$ through transducer $\mathbf{26}_k$.

Referring to FIGS. 2 and 3, it should be recognized that as beam 22 moves across the surface of a facet, reflected beam 24 scans through adjacent transducers $\mathbf{26}_i$ in detector array 28. However, as beam 22 moves between adjacent facets, reflected beam 24 moves to the opposite end of the adjacent facet's scan range without illuminating the other transducers in array 28. That is, as beam 22 moves from facet 18*b* onto facet 18*c*, reflected beam "jumps" from transducer $\mathbf{26}_k$ to transducer $\mathbf{26}_{k+x}$. Similarly as beam 22 moves from facet 18*c* onto facet 18*b*, reflected beam 24 "jumps" from transducer $\mathbf{26}_{k+x}$ to transducer $\mathbf{26}_k$.

Preferably, each facet 18 on surface 14 is positioned such that the beam 24 reflected from each facet 18 scans through the same set of transducers $\mathbf{26}_i$ in detector array 28. Positioning each facet 18 in such a manner reduces the number of elements in and the size of detector array 28. It is understood that scanning beam 24 through overlapping sets of transducers will also reduce the total number of transducers required in array 28. Additionally, in a preferred embodiment each facet 18 will reflect beam 24 over the same number of transducer elements $\mathbf{26}_i$. However, it is not required that each facet of surface 14 scan beam 24 through the same set or same number of transducers.

Referring once again to FIG. 1, in operation, source 20 produces a continuous wave beam 22 which is directed onto surface 14. As diaphragm 10 vibrates in response to acoustic energy incident upon face 12, the position that beam 22 strikes reflective surface 14 varies which, in turn, varies the position that reflected beam 24 strikes detector array 28. Upon illumination of array 28 by beam 24, each transducer $\mathbf{26}_i$ creates an electrical response, such as a charge or a current gain, proportional to the intensity of the light received at the array. The size of the response produced by each transducer $\mathbf{26}_i$ in array 28 can be used to provide an output value corresponding to the intensity of light received at the transducer. To accurately determine which transducer $\mathbf{26}_i$ beam 24 strikes, the diameter (cross-sectional height) of beam 24 should be less than the distance between the centers of any two adjacent transducers.

The output values from array 28 are transferred to microprocessor 32. Microprocessor 32 analyzes the data sent from array 28 to produce a digital output value corresponding to the displacement (position) of diaphragm 10. The displacement of diaphragm 10 is directly related to the facet and position along the surface of that facet that beam 22 strikes. Knowing the facet 18 that beam 22 strikes is used to produce the high-order bits of the digital output value, while knowing the position along the surface of the facet produces the low-order bits.

Microprocessor 32 obtains the position along the surface of facet 18 that beam 22 strikes by determining which transducer $\mathbf{26}_i$ in array 28 is illuminated. If each facet 18 reflects beam 24 through the same set of transducers $\mathbf{26}_i$ in array 28, then each transducer $\mathbf{26}_i$ will always correspond to the same position across the surface of each facet 18 and thus the same low order bits. However, if the facets do not reflect beam 24 through the same set of transducers $\mathbf{26}_i$ in array 28, then microprocessor 32 must know the illuminated transducer(s) $\mathbf{26}_i$ in array 28 as well as the facet 18 that beam 22 is striking to determine the low order bits.

Microprocessor 32 can determine which facet 18 of surface 14 beam 22 is striking by tracking jumps between transducers 26*i* illuminated by beam 24. As described above in reference to FIGS. 2 and 3, when reflected beam 24 moves from one facet to the next, the beam jumps to the opposite end of the adjacent facet's scan range without illuminating the other transducers in array 28. A large jump between illuminated transducers indicates that beam 22 has moved between facets, and the direction of the jump (i.e., transducer $\mathbf{26}_k$ to $\mathbf{26}_{k+x}$, or $\mathbf{26}_{k+x}$ to $\mathbf{26}_k$) indicates to which adjacent facet beam 22 has moved. Alternatively, one or more additional reflective surfaces can be disposed on face 16 of diaphragm 10 to identify which facet 18 of surface 14 is illuminated by beam 22. The use of such additional reflective surfaces disposed on face 16 is described below in reference to FIG. 4.

In FIG. 1, optical detector 28 and microprocessor 32 are shown as separate elements. However, it is understood that optical detector 28 can include processing means incorporated within the detector to perform the processing functions of processor 32. Similarly, a processing means can be included within optical detector 28 and used as a preprocessor to improve the performance of microprocessor 32. For example, a preprocessor in detector 28 can be used to produce the low order bits freeing microprocessor 32 to track which facet 18 of surface 14 is illuminated.

Figure 4:
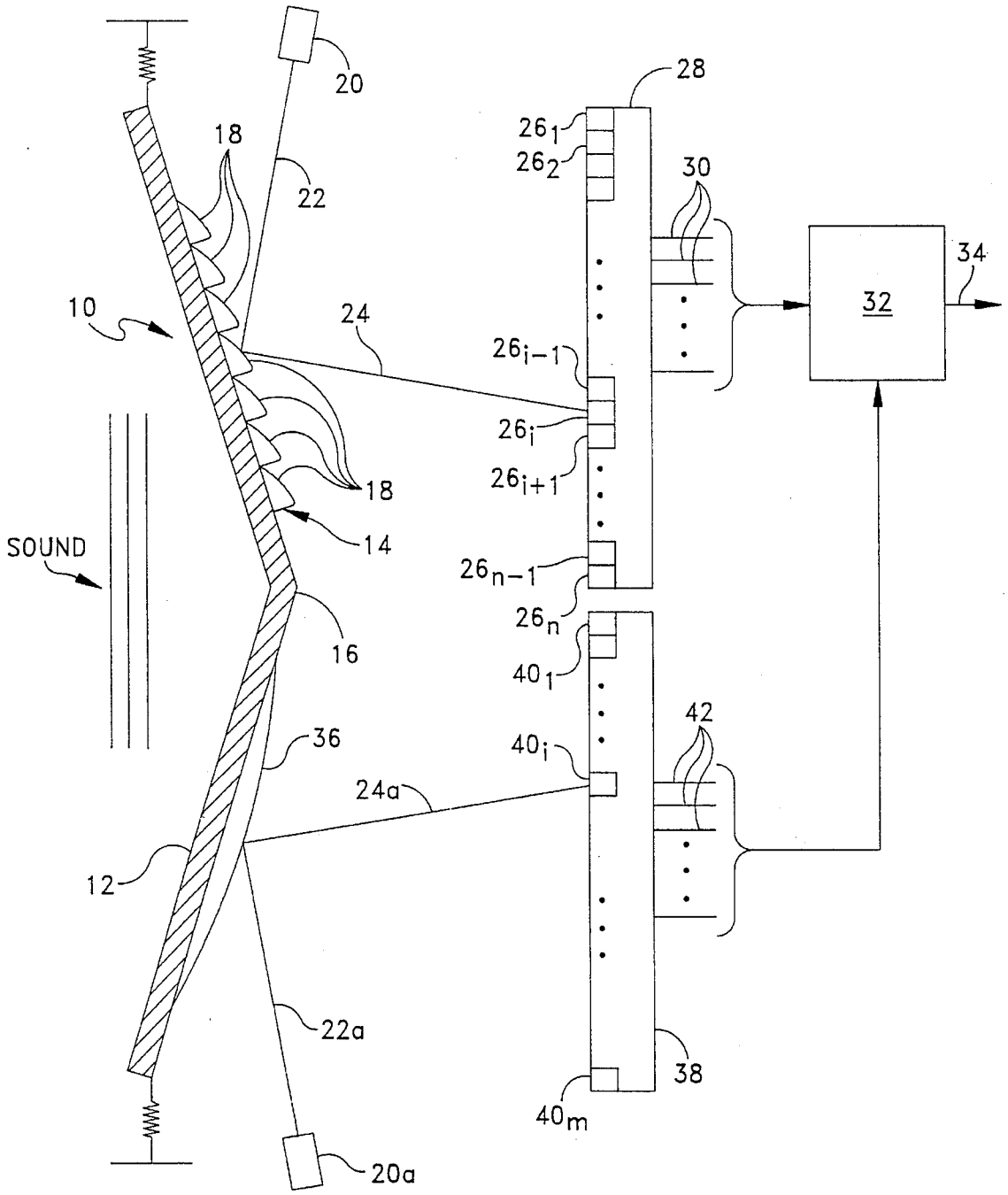
FIG. 4 is a diagram illustrating a second embodiment of a digital microphone in accordance with the present invention.

Referring now to FIG. 4, there is shown a second embodiment of a digital microphone in accordance with the present invention. In the embodiment of FIG. 4, the characteristics, requirements, and operation of elements with reference numerals identical to those in FIG. 1 are the same as previously described in reference to FIG. 1.

In FIG. 4, diaphragm 10 receives acoustic energy at face and is displaced a distance which is proportional to the amplitude of the acoustic energy received. Source 20 produces optical beam 22 that is directed onto reflective surface Beam 22 strikes one of the facets 18 of surface 14 and is reflected (as beam 24) onto transducer $\mathbf{26}_i$ within detector array 28. Each transducer $\mathbf{26}_i$ in array 28 provides an output value corresponding to the intensity of light received at the transducer. The data from array 28 is transferred through output 30 to microprocessor 32.

A source 20*a*, which can be a light emitting diode, a semiconductor laser, or the like, produces an optical beam 22*a* that is directed onto reflective surface 36. Surface 36 is a single facet reflective surface which reflects beam 22*a* onto detector array 38. The beam reflected off surface 36, identified as beam 24*a*, strikes transducer $\mathbf{40}_i$ within detector array 38. In FIG. 4, surface 36 is shown located some distance from surface 14 and illuminated by a second source 22*a*; however, it should be understood that surface 36 may be disposed near surface 14 with both surfaces being illuminated a beam from the same source.

Detector array 38 comprises a linear array containing m opto-electric transducer elements ($\mathbf{40}_1, \ldots, \mathbf{40}_m$) wherein individual transducers are generally identified as $\mathbf{40}_i$. Each transducer $\mathbf{40}_i$, which can be a charge coupled device, photodiode, phototransister, or the like, produces an electrical response proportional to the intensity of light received. The transducer elements can be read serially, in parallel, or in a serial/parallel combination to provide at output 42 an output signal comprising output values corresponding to the response produced at each transducer element. Output 42 of array 38 is directed to microprocessor 32 which analyzes the output values transferred from both array 28 and array 38 to produce a digital output value corresponding to the position of diaphragm 12.

In operation, source 20 and source 20*a* emit continuous beams 22 and 22*a* onto reflective surfaces 14 and 36. As diaphragm is displaced by acoustic energy incident upon face 12, the position on array 28 illuminated by beam 24 varies as described above. Similarly, the position on surface 36 illuminated by beam 22*a* as well as the position at which beam 24*a* strikes detector array 38 varies as diaphragm 19 is displaced. However, because surface 36 comprises a single reflective facet, beam 24*a* will be reflected through a single continuous scan range on detector 38. Thus, knowing the total displacement of surface 36 and the resulting scan range allows one to determine the displacement of surface 36, and thus diaphragm 10, by identifying the transducer $\mathbf{40}_i$ within the scan range that is illuminated. Furthermore, because the displacement of surface 36 equals the displacement of surface 14, the displacement of surface 36 can be used to determine which facet of surface 14 is illuminated by beam That is, if surface 36 has a scan range of sixty-four (64) transducers, the displacement of surface 36 could be used to distinguish which of up to sixty-four (64) different facets on surface 14 is illuminated by beam 22.

The use of an additional reflective surface to identify and distinguish between the facets of another surface can be extended to include the use two or more additional reflective surfaces each associated with a detector array. For example, using a first reflective surface comprising a single facet having a scan range of sixty-four transducers allows one to distinguish up to sixty-four different facets on a second surface. If the second surface has sixty-four (64) facets and each facet on the second surface also has a scan range of sixty-four transducers, the first and second surfaces could then be used to identify up to 4096 different transducers on the third surface. If each of the 4096 facets on the third surface had a scan range of sixteen (16) transducers, the three surfaces could be combined by a microprocessor to provide a sixteen bit digital output. With such an embodiment, the output of the detector array associated with the third surface provides the four lowest order bits, the second detector array provides the next 6 bits, and the array associated with the first surface provides the six highest order bits.

The device provides a novel approach for converting mechanical vibrations into a digital signal and offers several significant advantages over prior art systems. First, the device provides greater resolution of the displacement than prior art devices. More importantly, this increased resolution is obtained without greatly increasing the number of photoelectric sensors required in the detector array. The use of a multifaceted reflective surface with each facet reflecting a beam through the same set or overlapping sets of transducers reduces the number of photodetectors required. Second, the device is relatively small and portable and does not require complex components. The use of a linear detector array with a simple conversion to a digital value provides the advantage of avoiding a complex and sizable two-dimensional planar array or reflecting surface with complex bit patterns superimposed thereon.

It will be understood that various changes in the details, materials, steps and arrangement of parts, which have been herein described and illustrated in order to explain the nature of the invention, may be made by those skilled in the art within the principle and scope of the invention as expressed in the appended claims.

What is claimed is:

1. An apparatus for converting acoustic energy into a digital signal comprising:

a diaphragm positioned to receive acoustic energy for converting said acoustic energy into a displacement;

an array of reflective facets disposed on said diaphragm, wherein each reflective facet within said array moves in unison with every other reflective facet in response to said acoustic energy received by said diaphragm;

a light source for producing an optical beam, said beam being directed onto said array of reflective facets wherein a portion of said optical beam is reflected;

a photosensitive surface disposed to receive said optical beam reflected by said array of reflective facets for converting said reflected optical beam into an output signal; and processing means connected to receive said output signal from said photosensitive surface for producing a digital signal corresponding to the displacement of said diaphragm.

2. The apparatus of claim 1 wherein said photosensitive surface comprises a linear array of opto-electric transducers, each opto-electric transducer producing an electrical response proportional to the intensity of said reflected optical beam received by the opto-electric transducer and wherein said output signal comprises output values indicating the response produced at each one of said opto-electric transducers.

3. The apparatus of claim 2 wherein said processing means has a preprogrammed instruction set for periodically calculating from said output signal a first digital value identifying said opto-electric transducers illuminated by said reflected optical beam and for calculating, for each of said first digital values produced, a second digital value designating the displacement of said array of reflective facets.

4. An apparatus comprising:

a diaphragm positioned to receive acoustic energy for converting said acoustic energy into a displacement;

a light source for producing an optical beam;

a first reflective surface comprising a plurality of reflective facets, said first reflective surface being disposed on said diaphragm to receive said optical beam wherein a portion of said optical beam is reflected by said first reflective surface;

a second reflective surface comprising a single reflective facet, said second reflective surface being disposed on said diaphragm to receive said optical beam wherein a portion of said optical beam is reflected by said second surface;

a first photosensitive surface disposed to receive said optical beam reflected by said first reflective surface for converting said optical beam reflected by said first reflective surface into a first output signal;

a second photosensitive surface, disposed to receive said optical beam reflected by said second reflective surface, for converting said optical beam reflected by said second surface into a second output signal; and processing means connected to receive said first and second output signals for producing a digital signal corresponding to the displacement of said diaphragm.

5. The apparatus of claim 4 wherein said second photosensitive surface comprises a linear array of optical transducers, each optical transducer producing an electrical response proportional to the intensity of said optical beam reflected by said second surface received by the optical transducer and wherein said second output signal comprises output values indicating the response produced at each one of said optical transducers.

6. The apparatus of claim 5 wherein said processing means has a preprogrammed instruction set for periodically calculating from said second output signal a first digital value designating the displacement of said second reflective surface and for periodically calculating from said first digital value and said output signal a second digital value designating the displacement of said reflective surface and for producing said digital signal using said first and second digital values.

* * * * *